United States Patent [19]

Cadwell et al.

[11] Patent Number: 5,002,079

[45] Date of Patent: Mar. 26, 1991

[54] PRESSURE PULSE METHOD AND SYSTEM FOR REMOVING DEBRIS FROM NUCLEAR FUEL ASSEMBLIES

[75] Inventors: Dennis J. Cadwell, Murrysville; Richard D. Franklin, Jeannette, both of Pa.

[73] Assignee: Westinghouse Electric Corp., Pittsburgh, Pa.

[21] Appl. No.: 284,871

[22] Filed: Dec. 15, 1988

[51] Int. Cl.[5] ..... B08B 3/10

[52] U.S. Cl. ..... 134/166 R; 134/102; 134/104.4; 134/184; 134/111; 165/95

[58] Field of Search ..... 134/1, 22.12, 102, 104.4, 134/111, 182, 184, 186, 201, 166 R, 169 R; 165/95

[56] References Cited

U.S. PATENT DOCUMENTS

| | | | |
|---|---|---|---|
| 2,857,922 | 10/1958 | Effinger | 134/22.11 |
| 3,180,418 | 4/1965 | MacLeod . | |
| 3,409,470 | 11/1968 | Karpovich . | |
| 4,071,376 | 1/1978 | McNeer | 134/169 R X |
| 4,461,650 | 7/1984 | Ozawa . | |
| 4,492,113 | 1/1985 | Weqtherholt . | |
| 4,645,542 | 2/1987 | Scharton et al. . | |
| 4,655,846 | 4/1987 | Scharton et al. . | |
| 4,728,368 | 3/1988 | Pedziwiatr | 134/184 |
| 4,756,770 | 7/1988 | Weems et al. . | |
| 4,773,357 | 9/1988 | Scharton et al. . | |

FOREIGN PATENT DOCUMENTS

| | | |
|---|---|---|
| 16889 | 10/1980 | European Pat. Off. . |
| 106959 | 5/1984 | European Pat. Off. . |
| 265549 | 5/1988 | European Pat. Off. . |
| 339289 | 11/1989 | European Pat. Off. . |
| 1105984 | 4/1961 | Fed. Rep. of Germany . |
| 3716565 | 5/1986 | Fed. Rep. of Germany . |
| 8400564 | 2/1984 | Netherlands . |

*Primary Examiner*—Frankie L. Stinson

[57] ABSTRACT

Both a method and system are disclosed herein for removing debris from nuclear fuel assemblies which have been in service in a nuclear reactor. The method generally comprising immersing the fuel assembly in a pool of water which may be the cask loading pit of a nuclear facility, securing the fuel assembly in a spent fuel rack, enveloping the spent fuel rack in a rectangular sleeve in order to isolate the water surrounding the fuel assembly from the balance of the water in the cask loading pit, and discharging a series of pressure pulses into the isolated water from a pressure pulse source to create shock waves that exert momentary forces on the fuel rods sufficient to dislodge debris therefrom but insufficient to create a liftoff between the fuel rods and the spring fingers of the grids which retain them within the fuel assembly.

7 Claims, 5 Drawing Sheets

PRESSURE PULSE METHOD AND SYSTEM FOR REMOVING DEBRIS FROM NUCLEAR FUEL ASSEMBLIES

BACKGROUND OF THE INVENTION

This invention generally relates to methods for decontaminating the primary side of a nuclear steam generator by the removal of radioactive debris from fuel assemblies and is specifically concerned with the removal of such debris by immersing such fuel assemblies in water and subjecting them to shock waves generated by underwater pulses of pressurized gas.

Methods and systems for decontaminating the primary side of nuclear steam generators are known in the prior art. However, before the purposes and operation of these methods can be appreciated, some understanding of the structure and operation of a nuclear steam generator is necessary.

Nuclear steam generators are comprised of three principle components, including a secondary side, a tube sheet, and a primary side which circulates water heated from a nuclear reactor. The tube sheet hydraulically isolates the primary side from the secondary side. The secondary side of the generator includes a plurality of U-shaped heat exchanger tubes, as well as an inlet for admitting a flow of water. The inlet and outlet ends of the U-shaped tubes within the secondary side are mounted in the tube sheet that hydraulically separates the primary and the secondary sides. The primary side in turn includes a divider sheet which hydraulically isolates the inlet ends from the U-shaped tubes from the outlet ends. Hot, radioactive water flowing out of the core of the nuclear reactor is admitted into the section of the primary side containing all of the inlet ends of the U-shaped tubes. This hot, radioactive water flows through these inlets, up through the tube sheet, and circulates around the U-shaped tubes which extend within the secondary side of the generator. This water from the reactor transfers its heat through the walls of the U-shaped tubes to the non-radioactive feed water flowing through the secondary side of the generator, thereby converting feed water to non-radioactive steam that in turn powers the turbines of an electric generator. After the water from the reactor circulates through the U-shape tubes, it flows back through the tube sheet, through the outlets of the U-shaped tubes, and into the outlet section of the primary side, where it is recirculated back to the nuclear reactor.

The primary side of the generator includes a core barrel which houses approximately one hundred nuclear fuel assemblies which are uniformly spaced from one another. Each of the fuel assemblies, in turn, comprises a rectangular array of approximately two hundred fuel rods which are supported and contained within the fuel assembly skeleton. The skeleton, in turn, is formed from seven grids which are uniformly connected along an array of thimble rods. Each of the grids is formed from two sets of parallel, metal plates orthogonally disposed with respect to one another and which interfit in "egg crate" fashion to define a pattern of square cells which receive, support and uniformly space the fuel rods from one another. The walls of each of the cells in turn include spring fingers for resiliently biasing the center line of the rod along the center line of the cell.

In operation, the fuel rods may attain a temperature of 1800 degrees F. along their center lines as the result of the fission reaction which occurs within them. The heat generated by this fission reaction is removed by water which circulates between the reactor core and the inlet and outlets of the U-shaped heat exchanger tubes in the secondary side of the generator. Over time, radioactive debris is generated within the primary side both by the corrosion of the zircaloy cladding of the fuel rods, and the stainless steel components of the fuel assembly skeleton, as well as by the reduction of solid material out of the water from the nucleate boiling which occurs at the 1800 degree F. surface of the fuel rods.

As a result of the exposure of this debris to the intense radioactivity generated by the fuel rods, this debris becomes highly radioactive. Moreover, over time, particles of debris will break off of the fuel assemblies and become entrained in the water circulating through the primary side. Unfortunately, these highly radioactive particles of debris do not circulate continuously through the piping of the primary side; instead, they tend to deposit themselves at points along the primary side which generate regions of non-uniform flow, such as valves and elbow joints. The end result of this deposition over time is that the valves and elbow joints in the piping of the primary side can become radioactive enough to pose a very real radiation hazard to the maintenance operators which routinely service the piping in the containment area of the nuclear facility.

Various techniques for removing this highly radioactive particulate debris from the primary side have been developed in the prior art. Such techniques include the introduction of caustic chemicals in the primary side which dissolve and remove such contaminates, as well as the scrubbing of the channel head regions of the primary side by a high pressure stream of a water-grit mixture which abraids and rinses these particulate contaminates away (see for example U.S. Pat. Nos. 4,226,640 and 4,374,462). Unfortunately, the use of caustic chemicals may corrode and thin out the walls of various pipes and tubing in the primary side, while the use of a water-grit "sand blast" has been found to be effective only in localized areas of the primary side. Moreover, all of the techniques used to date have proven to be extremely expensive to implement.

Clearly, there is a need for a method for effectively decontaminating the primary side of a nuclear steam generator which is both effective throughout all portions of the primary side and relatively inexpensive.

SUMMARY OF THE INVENTION

Generally speaking, the invention is both a method and a system for removing radioactive debris from a nuclear fuel assembly in order to prevent particles of this debris from breaking off the fuel assembly and contaminating the primary side piping. The method comprises the steps of immersing the fuel assembly within a pool of water which may be the cask loading pit of a nuclear power facilitY, and discharging a series of pulses of pressurized gas into the water in the pool which exert momentary forces on the fuel rods sufficient to dislodge debris but insufficient to cause any liftoff from occurring between the fuel rods and the spring clips or other supports which retain them within the grids of the fuel assembly. In the preferred embodiment, each of the pulses is created by discharging about one to three cubic inches of an inert gas such as nitrogen at a pressure between 20 and 200 psi. The pulses are preferably created near the bottom end of the fuel assembly being cleaned, and are discharged at a frequency of between about 2 and 10 seconds for between about 1.5 and 8 hours.

In implementing the method of the invention, the fuel assembly or assemblies to be cleaned are preferably first supported within a spent fuel rack or equivalent structure to secure them in an upright position within the cask loading pit. To prevent the particular debris dislodged from the fuel assembly from circulating within and hence clouding all of the water in the cask loading pit, a tubular wall structure in the form of a rectangular sleeve of stainless steel plate is lowered over the spent fuel rack or other structure supporting the fuel assembly prior to the discharge of the pressure pulses. In the preferred system of the invention, the bottom edge of the rectangular sleeve snugly and sealingly engages the perimeter of the floor of the spent fuel rack when the sleeve is lowered thereover. The sleeve is made sufficiently long so that its top edge rises above the level of the water in the cask loading pool. The top edge of the sleeve is preferably covered by a foraminous lid which allows the gases generated by the pressure pulses to easily vent through the top of the sleeve, but prevents clouded water from splashing over the top end and into the cask loading pool.

The rectangular sleeve advantageously isolates the water surrounding the fuel assembly from the balance of the water in the cask loading pool during the pressure pulsing operation, and also concentrates the bubble agitation and the vertical displacement motion generated in the water by the pressure pulser around the fuel assembly. In the preferred embodiment, a recirculation and filtration unit is connected to the tubular wall structure in order to recirculate and filter out the dislodged debris that is suspended in the water contained therein. In the preferred method of the invention, the recirculation and filtration unit is preferably run for a time period after the pulsing stops in order to completely clear the water around the fuel assemblies before the rectangular sleeve is lifted out of the cask loading pool.

Finally, the bottom edge of the sleeve is preferably circumscribed by a flange which not only reinforces the bottom edge so that it maintains a complementary and snugly fitting shape with respect to the floor of the spent fuel rack during the pulsing operation, but further acts as a support for one or more pressure pulsers which are preferably located at the bottom of the sleeve.

By periodically removing the pincipal source of particulate contaminants in the primary side, the invention advantageously obviates the need for the periodic implementation of expensive decontamination procedures in the pipe work of the primary side. It is safe and reliable, and is fast enough to allow all one hundred or so fuel assemblies to be cleaned during an ordinary maintenance outage of the reactor. The fact that the method does not add any time to the critical path of normal maintenance operations is a particularly important aspect, since each day of reactor down-time typically costs the utility over $1,000,000 in lost revenues.

BRIEF DESCRIPTION OF THE SEVERAL FIGURES

Figure 7:
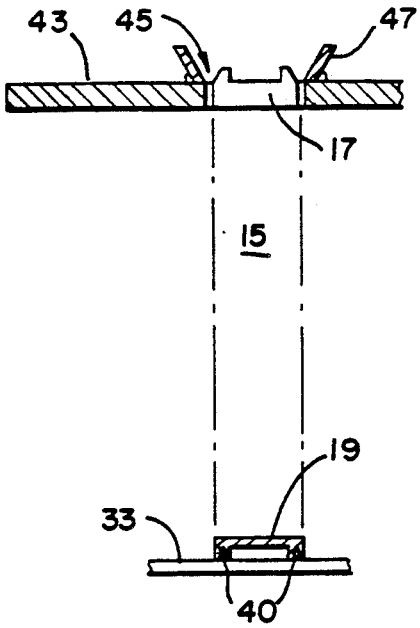
Figure 8:
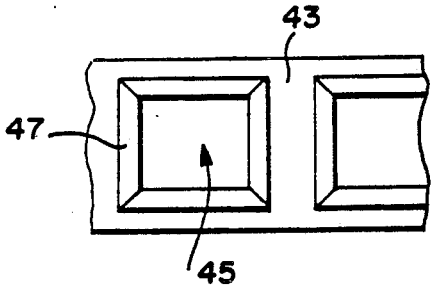
Figure 9:
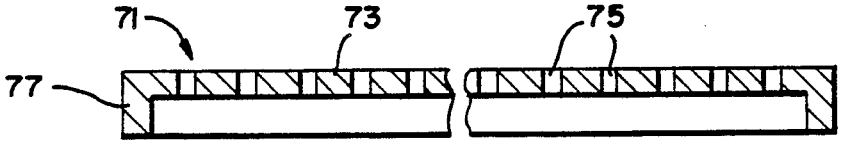
Figure 4:
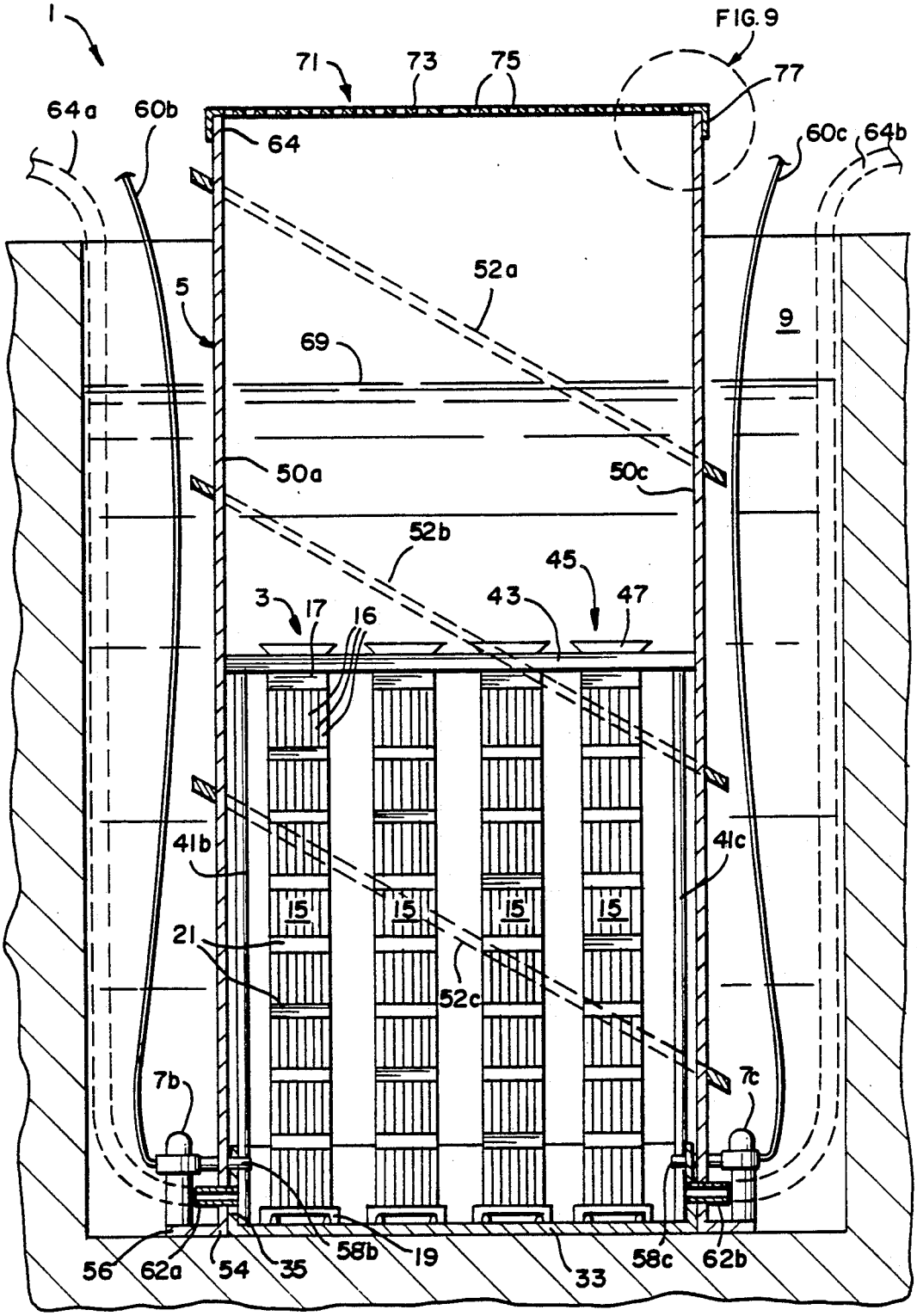
FIG. 4 is a side view of the system illustrated in FIG. 3 along the line 4—4.

FIGS. 7 and 8 are a partial cross sectional side view and a partial plan view of the top plate of the spent fuel rack of the system, illustrating the openings through which the fuel assemblies are slid through as well as the guide plate assemblies which help to funnel the bottom ends of the fuel assemblies through these openings, and FIG. 9 is an enlarged, foreshortened side view of the foraminous lid surrounded by the dotted circle shown in FIG. 4 that covers the top end of the rectangular sleeve.

DETAILED DESCRIPTION OF THE PREFERRED EMBODIMENT

Figure 1:
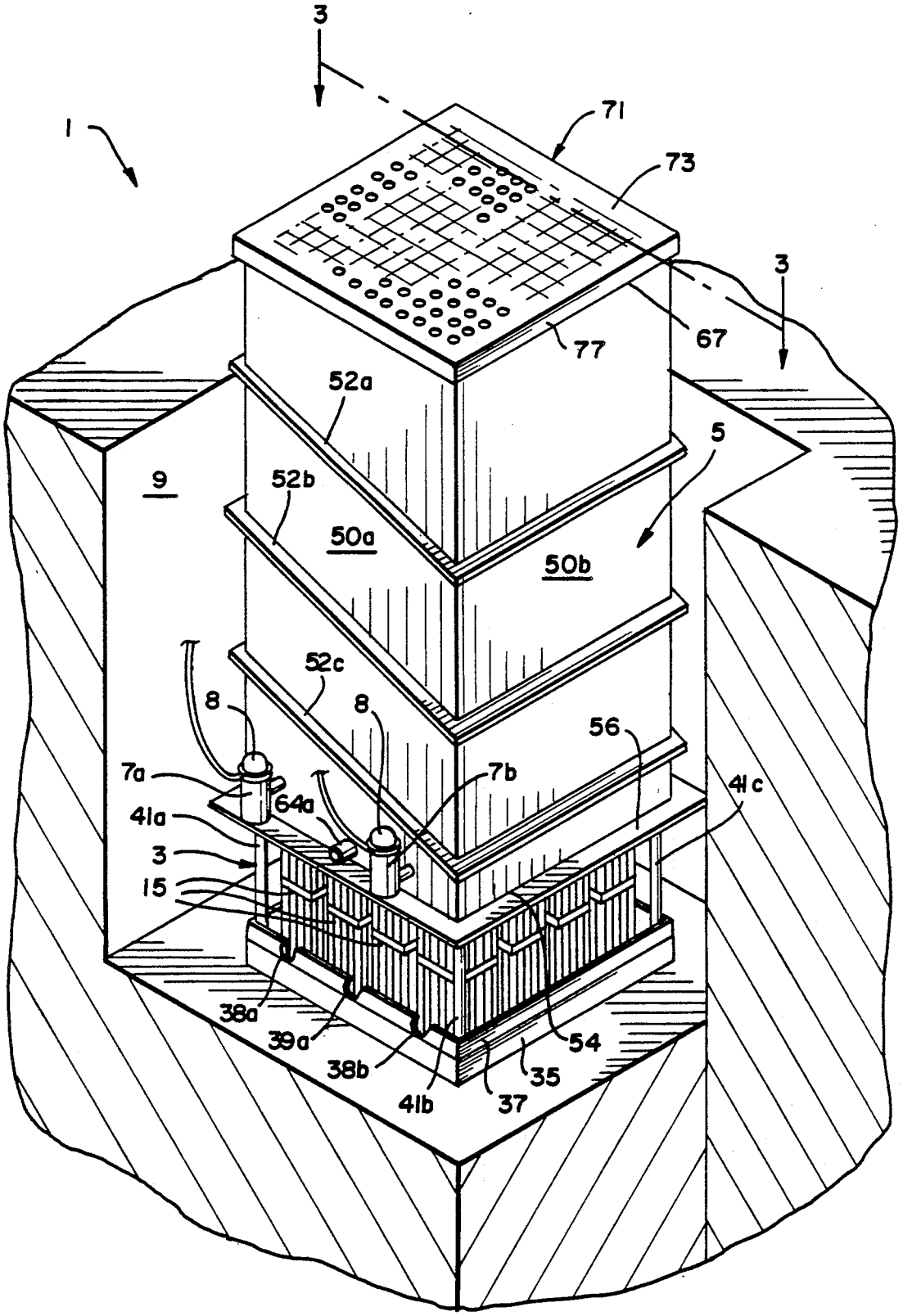
FIG. 1 is a perspective view of the debris removal system of the invention, illustrating how the rectangular sleeve of the system is slid over a spent fuel rack having fuel assemblies secured therein.
Figure 3:
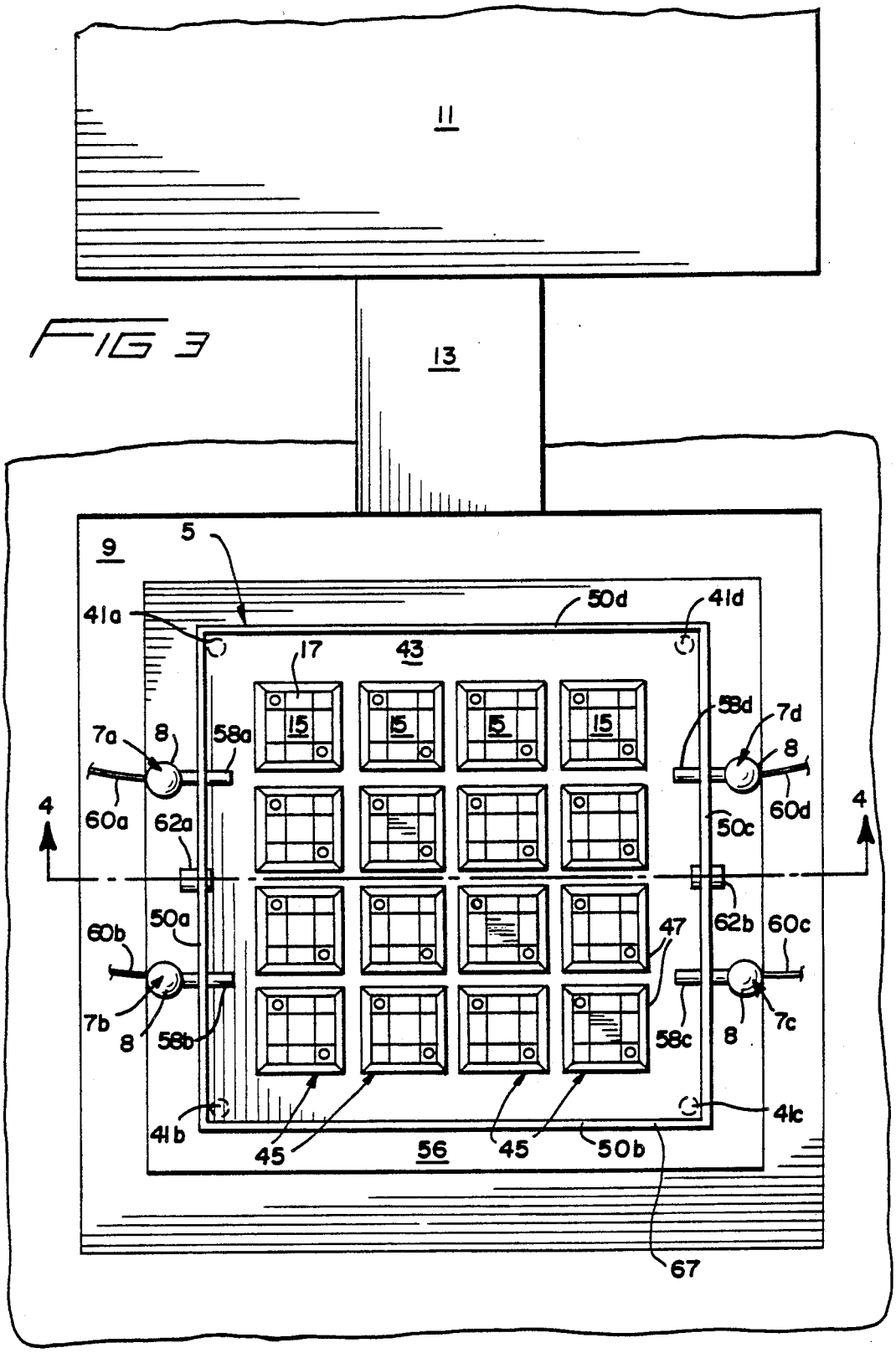
FIG. 3 is a plan view of the debris removal system illustrated in FIG. 1 along the line 3—3 with the foraminous lid that normally covers the top of the rectangular sleeve removed.

With reference now to FIGS. 1 and 3, wherein like numerals designate like components throughout all of the several figures, the inventive system 1 for removing contaminating debris from fuel assemblies generally comprises a conventional and commericially available spent fuel rack 3 in combination with a tubular wall structure formed from a rectangular sleeve 5 formed from stainless steel plate, and four pressure pulse generators *7a–7d* mounted around the bottom periphery of the sleeve 5 as shown. In the preferred embodiment, each of the pressure pulse generators *7a–7d* is a PAR 600D air gun manufactured by Bolt Technology, Inc., located in Norwalk, Conn. Each of these pressure pulse generators *7a–7d* includes a firing cylinder 8 having a total volumetric capacity of between 1 and 3 cubic inches of compressed gas. Such pressure pulse generators *7a–7d* are electrically fired by means of an electronic firing circuit (not shown) in combination with a solenoid operated valve. In the preferred embodiment, the firing circuit is preferably a model FC 100 controller manufactured by the previously mentioned Bolt Technology, Inc. Advantageously, each of the pressure pulse generators *7a–7d* is independently connected to the electronic controller so that these generators may be fired either synchronously or asynchronously. Additionally, a pulse flattener may be used within the firing cylinders of each of the pressure pulse generators *7a–7d* in order to minimize the maximum momentary force applied against the fuel rods of each fuel assembly by the shock waves generated by the gas pulses. The operation and structure of such a pulse flattener is described in copending U.S. patent application Ser. No. 183,874 filed Apr. 19, 1988 by the Westinghouse Electric Corporation and entitled "Improved Pressure Pulse Cleaning Method" by Auld et al., the entire specification of which is incorporated herein by reference.

The system 1 is preferably operated within the cask loading pool 9 of a nuclear power facility. Such cask loading pools 9 are approximately twelve feet square, and have concrete walls which are approximately forty feet deep. Such pools 9 are typically filled with approximately thirty-five feet of water, and are connected to the spent fuel pool 11 of the facility (which is much larger in area) by means of a fuel transfer canal 13 as shown. While it would be possible to operate the system 1 in the spent fuel pool 11, the cask loading pool 9 is preferred since it provides the system operators with the opportunity to prevent any clouded water generated by the system 1 from entering into the spent fuel pool 11 by closing off the flow of water through the canal 13. This is a significant advantage, as such cloudy water could interfere with the routine maintenance and disposal operations conducted on fuel assemblies and other components stored within the fuel spent pool 11.

Figure 2B:
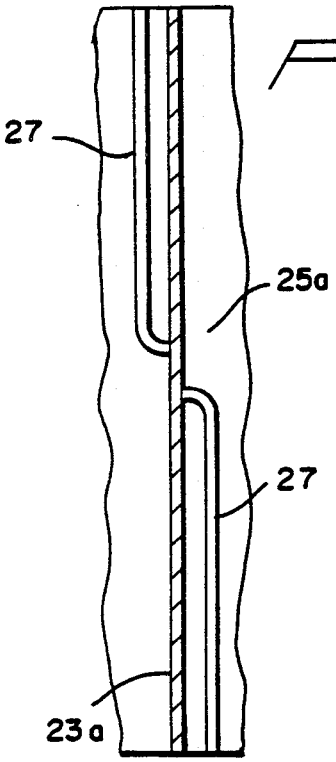
FIG. 2B is a partial cross sectional side view of the grid cell illustrated in FIG. 2A along the line 2B—2B, illustrating the structure of the spring fingers which resiliently bias the fuel rod toward the center of the cell.
Figure 2A:
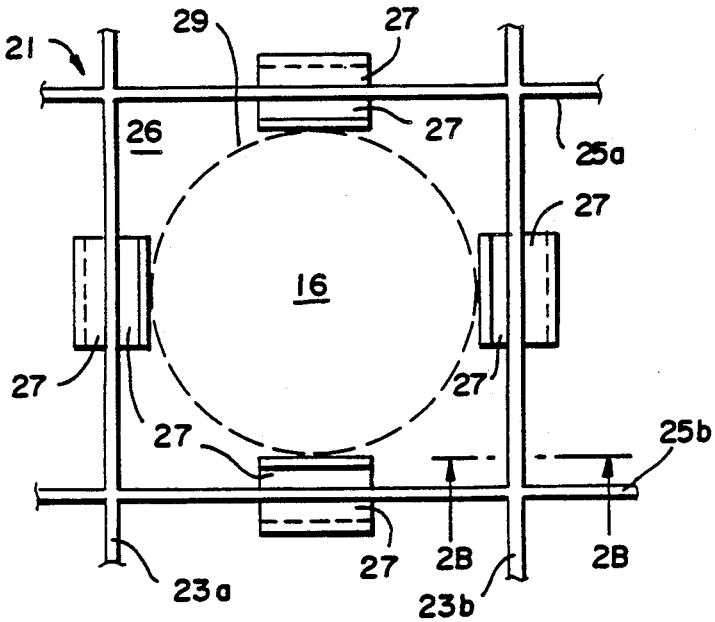
FIG. 2A is a plan view of one of the rod containing cells of one of the grids of fuel assembly, with the fuel rod illustrated in phantom.

With reference now to FIGS. 2A, 2B and 4, the system 1 is designed to simultaneously clean sixteen fuel assemblies 15. In order to understand the cleaning action of the system 1, it is first necessary to understand at least in general terms the structure of such fuel assemblies 15. Assemblies 15 are generally comprised of approximately two hundred nuclear fuel rods 16 (each of which is approximately thirteen feet long) arranged in a square array and confined between their top and bottom ends by a top nozzle 17, and a bottom nozzle 19. The fuel rods 16 are laterally supported by and spaced in a square array by approximately seven grid assemblies 21 which are uniformly spaced along the longitudinal axis of fuel assembly 15. As is best seen with respect to FIG. 2A, each grid is formed from two sets of parallel plates 23*a, b* and 25*a, b* which are orthogonally disposed and mutually interfitted with one another by means of complementary slots in an "eggcrate" fashion. These sets of parallel plates 23*a, b* and 25*a, b* (of which only two of each set are shown) form an array of uniformly spaced square cells 26 (only one of which is shown). Each of these cells 26 houses a fuel rod 16. In order to keep the center line of the fuel rod 16 co-linear with the center of the cell 26, each of the walls of the cell 26 includes a resilient means which may, for example, take the form of a leaf spring 27 as shown in both FIGS. 2A and 2B. These leaf springs 27 may be formed by punching out a portion of each cell wall.

Under normal operating conditions, the leaf springs 27 generally serve to maintain the center line of each fuel assembly rod 16 co-linear with the center line of each cell 26. However, if strong cross-currents of water are introduced into the core barrel (as, for example, has occurred in the past due to gaps between the baffle plates which circumscribe the core barrel) the fuel rod 16 can laterally vibrate within the cells 26 to an extent to where lift-off occurs between the leaf springs 27, and the surface 29 of the fuel rod 16. Over time, such spring lift-off in conjunction with the vibratory movement of the rod 16 has been known to cause localized erosion of the zircaloy cladding forming the exterior of such fuel rods 16. Such erosion is generally referred to as "fretting" in the art. As a result of the applicant's knowledge of the destructive effects that such fretting has upon the outer surfaces of fuel rods, applicant has selected specific ranges of pressures and volumes of gas to be used in conjunction with the pressure pulse generators 7*a–7d* which are powerful enough to remove the debris caused by the corrosion of the various parts of the fuel assembly 16 and nucleate boiling at the interface between the 1800 degree F. rod surface 29 and the surrounding water, but yet which is not sufficiently powerful to laterally displace any of the fuel rods 16 within the cells 26 to cause the leaf springs 27 to lift-off the rod surface 29.

Figure 5:
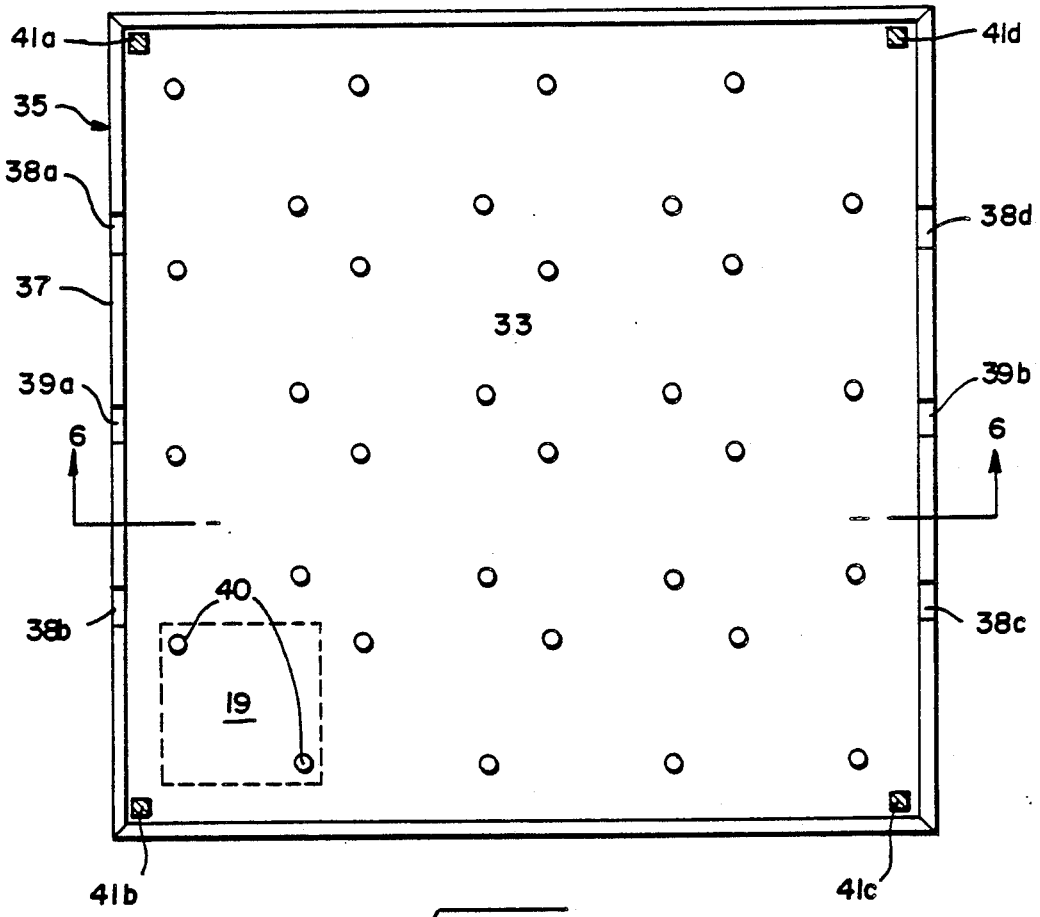
FIG. 5 is a plan view of the floor plate of the spent fuel rack used in the system of the invention with both the fuel assemblies and rectangular sleeve removed.
Figure 6:
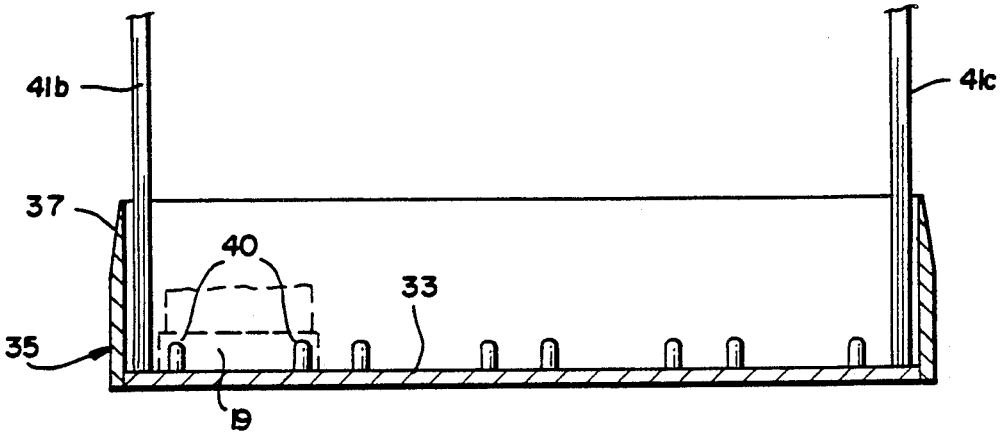
FIG. 6 is a cross sectional side view of the floor plate illustrated in FIG. 5 along the line 6—6.

With reference now to FIGS. 4, 5, and 6, the spent fuel rack 3 includes a floor plate 33 formed from a square plate of a non-corrosive metal such as stainless steel. With the exception of the sealing flange 35, floor plate 33 and all of the other components of the spent fuel rack 3 are conventional. The sealing flange 35 circumscribes the perimeter of the floor plate 33, and is preferably formed from the same metal forming the floor plate 33 so that the two may be easily welded together. As is best seen in FIG. 6, the upper part of the sealing flange 35 includes a tapered portion 37. In operation, the tapered portion 37 helps to lead-in the bottom edge of the rectangular sleeve 5 which is lowered over the entire spent fuel rack 3 in preparation for the cleaning operation. The bottom, non-tapered portion of the flange 35 is closely dimensioned to the inner walls of the bottom edge of the rectangular sleeve 5 so that the outer surface of the flange 35 and inner surface of the bottom edge of the sleeve 5 snugly interfit in sealing engagement in order to prevent the cloudy water generated within the sleeve 5 during the cleaning operation from flowing into the balance of the water in the cask loading pool 9. To avoid mechanical interference between the sealing flange 35 and the nozzles of the pressure pulse generators 7*a–7d* and the nozzles of the recirculation infiltration assembly, semi-circular recesses 38*a–38d* and 39*a*. 39*b* are provided in opposing sides of the flange 35 is shown. To secure the bottom nozzles 19 of each of the fuel assemblies 15, the floor plate 33 is provided with sixteen pairs of catty-cornered securing pins 40. Each of these securing pins 40 is bluntly tapered (as is best seen in FIG. 6) so as to be easily perceived within pre-existing pin-holes normally present within the feet of the bottom nozzles 19 of fuel assemblies 15. Finally, the floor plate 33 is provided with rack support columns 41*a–41d* in each of its corners to support the top plate 43 of the spent fuel rack 3.

Turning now to FIGS. 3, 7 and 8, the top plate 43 of the spent fuel rack 3 includes sixteen square openings 45 for receiving fuel assemblies 15. The inner edge of each of these openings 45 is closely dimensioned to the outer edge of the top nozzle 17 of each of the fuel assemblies 15 so that when a fuel assembly 15 is lowered through an opening and stood on the floor plate 33 and a pair of securing pins 40 is received within the holes present in the feet of the bottom nozzle 19, relatively little clearance will exist between the outer walls of the top nozzle 17 and the inner walls of the opening 45. Such close dimensioning, of course, allows the spent fuel rack 3 to firmly hold fuel assemblies 15 during the cleaning operation with a minimum of vibration occurring between the rack 3 and the fuel assemblies 15. To facilitate the insertion of the bottom nozzle 19 through the openings 45, each of these openings is circumscribed by a guide plate assembly 47 which is essentially a square-shaped funnel formed from the same stainless steel as the top plate 43. Each of these guide plate assemblies 47 is preferably welded around the top edge of its respective opening 45 as indicated in FIG. 7.

With reference again to FIGS. 3 and 4, the rectangular sleeve 5 of the system 1 is generally formed from four walls 50*a–50d*, each of which is formed from stainless steel plate material approximately 0.25 inches thick.

Each of these walls 50a–50 d is continuously welded along its lateral edges to the adjoining walls so as to form a sleeve structure which is water tight at all points along its height. The walls 50a–50 d of the sleeve 5 are rigidified by means of three sets of angle iron braces 52a–52c in order to prevent these walls from buckling when the sleeve 5 is lifted and lowered over the fuel rack 3. These braces 52a–52c further help prevent the bottom edge 54 of the sleeve 5 from bulging out of engagement with the sealing flange 35 of the floor plate 33 when the pressure pulse generators *7a–7d* operate to create pulses of pressurized gas in the water contained within the sleeve 5. However, to completely insure that no such leak-causing bulging will occur, the bottom edge 54 of the sleeve 5 is further rigidified by means of a reinforcing flange 56. It should be noted that the reinforcing flange 56 further serves as a support for the pressure pulse generators *7a–7d*.

Two opposing walls 50a and 50c of the sleeve 5 are provided with pulser nozzles 58a, 58b, and 58c, 58d, respectively. One end of each of these nozzles 58a–58d is connected to the firing cylinder 8 of one of the pressure pulse generators *7a–7d*, while the other end of the nozzle extends a short distance into the interior of the sleeve 5. Each of the nozzles 58a–58d is located near the bottom of the fuel assemblies 15 in order to maximize the debris-dislodging effects created by the pressurized pulses of gas. These gas pulses generate a three way cleaning action. First, the pulses create spherical shock waves within the sleeve interior that sharply impinge all the surfaces of the fuel assemblies 15 SecondlY, these same pulses displace the water at the bottom of the sleeve 5 so as to move all of the water momentarily and sharply upwardly in the sleeve 5. Thirdly, the pulses *7a–7d* agitate this water in the sleeve 5 as a result of the breaking up of the gas pulse into numerous small bubbles which vertically rise and circulate through the fuel assemblies 15. To minimize the localized momentary stresses that the spherical shock waves apply to the fuel rods 16 of the fuel assemblies 15, each of the nozzles 58a–58d is aligned between two of the four rows of fuel assemblies as is best seen in FIG. 3. Such alignment helps to prevent any lift-off from occurring between the fuel rods 16 closest to the nozzles 58a–58d from lifting off of the leaf springs 27 which space them within the cells 26 of the various grids 21 of the fuel assemblies 15.

With reference again to FIG. 4, each of the pressure pulse generators *7a–7d* is detachably connected to a gas supply line 60a–60 d. Additionally, each of the firing cylinders 8 of these pressure pulse generators *7a–7d* is electrically connected to the previously mentioned firing controller by means of a waterproof electrical cable (not shown). To remove the particulate debris dislodged from the fuel assemblies 15 from the water within the sleeve 5, the system 1 also includes a filtration and recirculation system that generally comprises opposing inlet and outlet nozzles 62a, 62b mounted in opposing walls 50a, 50c of the sleeve 5. Each of these nozzles 62a, 62b is in turn connected to a flexible recirculation type 64a, 64b. The other ends of the pipes 64a, 64b are connected to a pump and a cartridge type filter (not shown) which removes particular debris that becomes suspended within the water present in the sleeve 5. In operation, one of the nozzles 62a serves to continuously remove water from within the sleeve 5, while the other nozzle 60b reintroduces the filtered water back into the sleeve 5.

With reference now to FIGS. 4 and 9, the top edge 67 of the sleeve 5 preferably rises above the level 69 of the water present within the cask loading pool 9 so as to completely isolate the water surrounding the fuel assemblies 15 within the sleeve 5 from the balance of the water in the pool 9. To prevent the water within the sleeve 5 from splashing over the edge 67, a foraminous lid 71 is provided over the edge 67. Lid 71 is generally formed from a top plate 73 of stainless steel plate approximately 0.25 inches in thickness which has a square array of gas-conducting holes 75, each of which is approximately 0.25 inches in diameter. These holes 75 are arranged in an approximately two inch square pitch. The purpose of these holes 75 is to allow the gases emanated by the pressure pulse generator *7a–7d* to readily pass into the ambient atmosphere while at the same time to prevent water from splashing out of the sleeve 5. A circumferential mounting flange 77 is provided around the edge of the top plate 73 in order to secure the foraminous lid 71 around the top edge 67 of the sleeve 5.

In the method of the invention, the fuel assemblies 15 to be cleaned are first taken from the spent fuel pool 11 across the canal 13 and hoisted over the top plate 43 of the spent fuel rack 3 by the crane (not shown) normally present in such areas. Next, the fuel assemblies 15 are lowered through the openings 45 and the top plate 43. This aspect of the operation is, of course, facilitated by the guide plate assemblies 47 which circumscribe each of the openings 45 in order to funnel the bottom ends of the fuel assemblies 15 into their respective openingS 45. After each of the fuel assemblies 15 is positioned within the spent fuel rack in the upright orientation illustrated in FIG. 7, the rectangular sleeve 5 is lowered over the entire spent fuel rack 3 as is seen in FIG. 1. During the last stages of this lowering operation, the tapered portion 37 of the floor plate 33 of rack 3 helps to guide and to securely wedge the bottom edge 54 of the sleeve 5 around the sealing flange 35.

After the bottom edge 54 of the sleeve 5 has been properly positioned around the sealing flange 35 of the floor plate 33, the pulsing operation begins. In the preferred embodiment, each of the firing cylinders 8 of the pressure pulse generators *7a–7d* has been sized to hold approximately 2 cubic inches of gas. An inert gas (such as nitrogen) is introduced into these chambers at a pressure of approximately 50 psi (although the pressure may be as high as 160 psi). Each of the pressure pulse generators *7a–7d* is then discharged at a frequency of approximately 5 seconds (although the frequency of discharge may be anywhere between 2 and 10 seconds). While all of the pressure pulse generators *7a–7d* may be pulsed at the same time, some degree of asynchronious pulsing is desired so as to prevent the formation of nodes in the shock wave pattern in the water contained within the sleeve 5. The creation of such nodes could come of course, result in a non-uniform cleaning action on certain areas of the fuel assemblies 15. During the pulsing operation, the filtration and recirculation system is actuated so as to continuously recirculate the water contained within the sleeve 5 through a filter to remove the particulate debris dislodged from the fuel assemblies 15. Such removal is important, for two reasons. First, the removal of such dislodged debris completely out of the cask loading pool 9 prevents it from re-settling on to the fuel assemblies 15 being cleaned. Secondly, such removal prevents the introduction of cloudy water within the spent fuel pool 11 after the sleeve is raised out of the cask loading pool 9.

To determine the duration of the pulsing operation, the density of particular debris dislodged from the fuel assemblies 15 and flowing through the pipes, 60*a*, 60*b* of the recirculation and filtration system is closely monitored. When the particulate density is low enough to suggest that the fuel assemblies 15 have been substantially cleaned, the pulsing operation is stopped. In absolute terms, the duration of the pulsing operation may be any where between 0.5 and 8 hours, but is most normally approximately 1 hour.

After the pressure pulse operation is stopped, the water within the sleeve 5 is recirculated through the filtration and recirculation system for approximately another fifteen minutes to further remove particular debris therefrom. After the last recirculation step is accomplished, the rectangular sleeve 5 is lifted from the floor plate 33 of the spent fuel rack 3 by means of a crane, and the cleaned fuel assemblies 15 are returned to service, whereupon the cleaning method may be repeated for another batch of fuel assemblies 15.

We claim:

1. A system for removing debris from a nuclear fuel assembly of the type having a plurality of fuel rods, each of which is engaged by spring retaining means within a grid, comprising:

(a) means for securing said fuel assembly within a pool of water;

(b) means for isolating the water surrounding the fuel assembly in the securing means, and (c) at least one pressure pulse source in communication with the water isolated within said isolation means for discharging a series of pulses of pressurized gas within said isolated water that create shock waves for exerting momentary forces on the fuel rods sufficient to dislodge debris but insufficient to cause any of said fuel rods to momentarily disengage said spring retaining means.

2. A system for removing debris from a nuclear fuel assembly, comprising:

(a) rack means having a floor for securing said fuel assembly within a pool of water;

(b) a tubular wall structure for isolating the water surrounding the fuel assembly in the rack means, said wall structure having a bottom edge that is slideable over said rack means into engagement around said floor of said rack means, and (c) at least one pressure pulse source mounted onto said tubular wall means and in fluid communication with the water isolated therein for discharging a series of pulses of pressurized gas within said isolated water that creates shock waves for exerting momentary forces on the fuel rods sufficient to dislodge debris but insufficient to cause any of said fuel rods to momentarily disengage said spring retaining means.

3. The system defined in claim 2, wherein said bottom edge of said tubular wall structure sealingly engages the perimeter of the floor of the rack means as a result of its own weight.

4. The system defined in claim 3, wherein the perimeter of the floor of the rack means includes a flange which co-acts with the bottom edge of the tubular wall structure to effect a seal.

5. The system defined in claim 2, wherein the bottom edge of said tubular wall structure includes a flange for both reinforcing said bottom edge and for supporting said pressure pulse source.

6. The system defined in claim 2, further including a filtration and recirculation means for recirculating and filtering out debris in the isolated water within the tubular wall structure.

7. A system for removing debris from a nuclear fuel assembly of the type having a plurality of fuel rods, engaged by a spring retaining means within a grid, comprising:

(a) means for securing said fuel assembly within a pool of water, and (b) at least one pressure pulse source in communication with the water for creating shock waves with the pressurized pulses of gas to exert momentary forces on the fuel rods sufficient to dislodge debris but insufficient to cause substantial lift-off between said fuel rods and said spring retaining means.

* * * * *